United States Patent [19]

Hooper et al.

[11] Patent Number: 5,056,334

[45] Date of Patent: Oct. 15, 1991

[54] APPARATUS AND METHOD FOR MAKING PURE WATER

[75] Inventors: Charles R. Hooper, St. Paul; Herbert H. Rhoda, White Bear Lake, both of Minn.; Philip B. Stace, Knight Township, Vanderburgh County, Ind.

[73] Assignee: Whirlpool Corporation, Benton Harbor, Mich.

[21] Appl. No.: 514,145

[22] Filed: Apr. 25, 1990

[51] Int. Cl.[5] ..... F25C 5/18

[52] U.S. Cl. ..... 62/320; 62/344

[58] Field of Search ..... 62/123, 124, 320, 344, 62/347, 348, 352, 532; 414/293; 222/129, 146.6, 183

[56] References Cited

U.S. PATENT DOCUMENTS 2,210,319 8/1940 Hughes ..... 414/293
2,937,508 5/1960 Garland ..... 62/344 X
4,897,099 1/1990 Ruff ..... 62/532
4,941,902 7/1990 Ruff ..... 62/532

*Primary Examiner*—William E. Tapolcai
*Attorney, Agent, or Firm*—Wood, Phillips, Mason, Recktenwald & VanSanten

[57] ABSTRACT

An improvement is disclosed in an ice making apparatus having a cabinet provided with means for forming a plurality of ice bodies and an ice collecting bin therebelow for storing formed ice bodies. The improvement comprises a water storage tank positioned in the ice collecting bin and having an open top portion for receiving a select portion of the plurality of ice bodies formed by the forming means and to melt the same to provide fresh water. The top portion is positioned to prevent entry of ice bodies from the collecting bin. Means are provided for delivering a desired quantity of fresh water from the tank to a water dispenser associated with the cabinet.

25 Claims, 6 Drawing Sheets

APPARATUS AND METHOD FOR MAKING PURE WATER

FIELD OF THE INVENTION

This invention relates to ice makers and, more particularly, to an ice maker which provides for dispensing of pure water.

BACKGROUND OF THE INVENTION

In Barnard et al, in U.S. Pat. No. 4,009,595, owned by the assignee hereof, an ice cube making apparatus is disclosed wherein the ice is formed as a slab of clear ice sufficient in size to form a number of ice cubes. When a slab of the desired thickness is produced on an evaporator portion of the ice maker, the freezing operation is discontinued and the support on which the ice slab is formed is heated to disengage the slab of ice and cause it to move downwardly onto a grid of electrically heated wires which slowly melt through the ice separating the slab into individual cubes.

To form the ice on an evaporator plate, water is recirculated over the plate by means of a pump, the water flowing downwardly from the plate being collected in a water pan for return to an upper end of the evaporator plate by the action of the pump.

With such an ice maker, during the ice forming process the minerals and other impurities remain in the circulating water stream and only pure water solidifies as ice. The impurity rich water is then flushed from the system. The so-called clear ice is then available for withdrawal.

It has been found that when the clear ice melts the resulting product is water having very low impurity content, i.e. substantially pure water, and this water compares favorably to bottled drinking water.

The ice cube making apparatus disclosed in the Barnard et al. patent utilizes an insulated cabinet which is not refrigerated. Therefore, any ice cubes stored in a collecting bin eventually melt to produce clear water. Although such melted water is suitable for drinking, it may be contaminated due to the introduction of impurities or bacteria and the like caused by the removal of ice from the collecting bin by hands or other instruments.

The present invention is directed to solving one or more of the problems set forth above.

SUMMARY OF THE INVENTION

In accordance with the invention, an ice making apparatus is provided with means for storing and dispensing pure water as a by product of the ice.

In accordance with one aspect of the invention, an improvement is disclosed in an ice making apparatus having a cabinet provided with means for forming a plurality of ice bodies and an ice collecting bin therebelow for storing formed ice bodies. The improvement comprises a water storage tank positioned in the ice collecting bin and having an open top portion for receiving a select portion of the plurality of ice bodies formed by the forming means and to melt the same to provide fresh water. The top portion is positioned to prevent entry of ice bodies from the collecting bin. Means are provided for delivering a desired quantity of fresh water from the tank to a water dispenser associated with the cabinet.

It is a feature of the invention that the tank open top portion is of a size selected to determine the relative quality of ice bodies received in the storage tank.

It is another feature of the invention that the tank is removable from the collecting bin.

It is a further feature of the invention that the improvement may further comprise means for heating the water storage tank to facilitate melting of ice bodies received therein.

It is yet another feature of the invention that the delivering means comprises a pump.

In accordance with a further aspect of the invention there is disclosed herein a pure water dispensing apparatus in a slab-type ice maker. The ice maker has a cabinet provided with a inner liner defining an ice collecting bin, a slab-forming evaporator forming an ice slab, and a slab-cutting grid for cutting the slab to provide a plurality of ice bodies which fall into the ice collecting bin. The pure water dispensing apparatus comprises a water storage tank having an open top portion Means are provided for positioning the tank in the collecting bin with the open top portion disposed subjacent a select portion of the slab-cutting grid so that the storage tank receives a select portion of the plurality of ice bodies cut by the slab-cutting grid and to melt the same to provide fresh water. Means are provided for delivering a desired quantity of fresh water from the tank to the water dispenser associated with the cabinet It is a feature of the invention that the dispensing means comprises a conduit extending between the tank and a spigot mounted on the cabinet.

It is another feature of the invention that the apparatus further comprises means associated with the storage tank for preventing entry of ice from the collecting bin.

It is yet another feature of the invention that the storage tank is positioned to permit overflow of pure water into the collecting bin.

In accordance with yet a further aspect of the invention there is disclosed herein a combined ice cube maker and pure water dispensing apparatus. The apparatus includes a cabinet provided with an inner liner defining an ice collecting bin, an access opening for providing access to the collecting bin and a door for closing the opening. An ice maker is mounted in the cabinet including a slab-forming evaporator forming an ice slab, and a slab-cutting grid for cutting the slab to provide a plurality of ice cubes which fall into the ice collecting bin. A water storage tank has an open top portion. Means are provided for mounting the tank in the collecting bin with the open top portion disposed subjacent a select portion of the slab-cutting grid so that the storage tank receives a select portion of the plurality of ice cubes cut by the slab-cutting grid and to melt the same to provide fresh water. Means are provided for delivering a desired quality of the fresh water from the tank to a water dispenser associated with the cabinet.

There is disclosed herein in accordance with yet a further aspect of the invention a pure water dispensing apparatus insert kit for use with a slab-type ice maker. The slab-type ice maker has a cabinet provided with an inner liner defining an ice collecting bin, a slab-forming evaporator forming an ice slab, and a slab-cutting grid for cutting the slab to provide a plurality of ice parties which fall into the ice collecting bin. The pure water dispensing apparatus insert kit comprises a water storage tank having a bottom wall connected to a peripheral side wall to provide an open top portion, the tank being positionable in the collecting bin with the open top portion disposed subjacent a select portion of the slab-cutting grid so that the storage tank receives a select portion of the plurality of ice bodies cut by the slab-cutting grid to melt the same to provide fresh water. A pump is removably mounted in the storage tank. Means are provided for delivering a desired quantity of fresh water from the tank via the pump to a water dispenser mountable to the cabinet.

More specifically, there is disclosed herein an ice maker and pure water dispenser wherein ice is produced by circulating tap water over a below-freezing evaporator, and the minerals and other impurities remain in the circulating water stream and only pure water solidifies as ice. The impurity rich water is flushed from the system. A pure water storage tank intercepts a portion of each batch of ice released by a cutter grid which divides each slab of ice into cubes. In this arrangement, the contents of the storage tank will not be affected by any contamination of the otherwise stored ice. A heater, which may be located in the storage tank, may be used to increase the rate of water production. The purified water may be available through a water fitting when a glass is pressed against a water dispenser level A dispensing pump is used to transfer water from the tank to the water fitting.

Further features and advantages of the invention will readily be apparent from the specification and from the drawings

DESCRIPTION OF THE INVENTION

Figure 1:
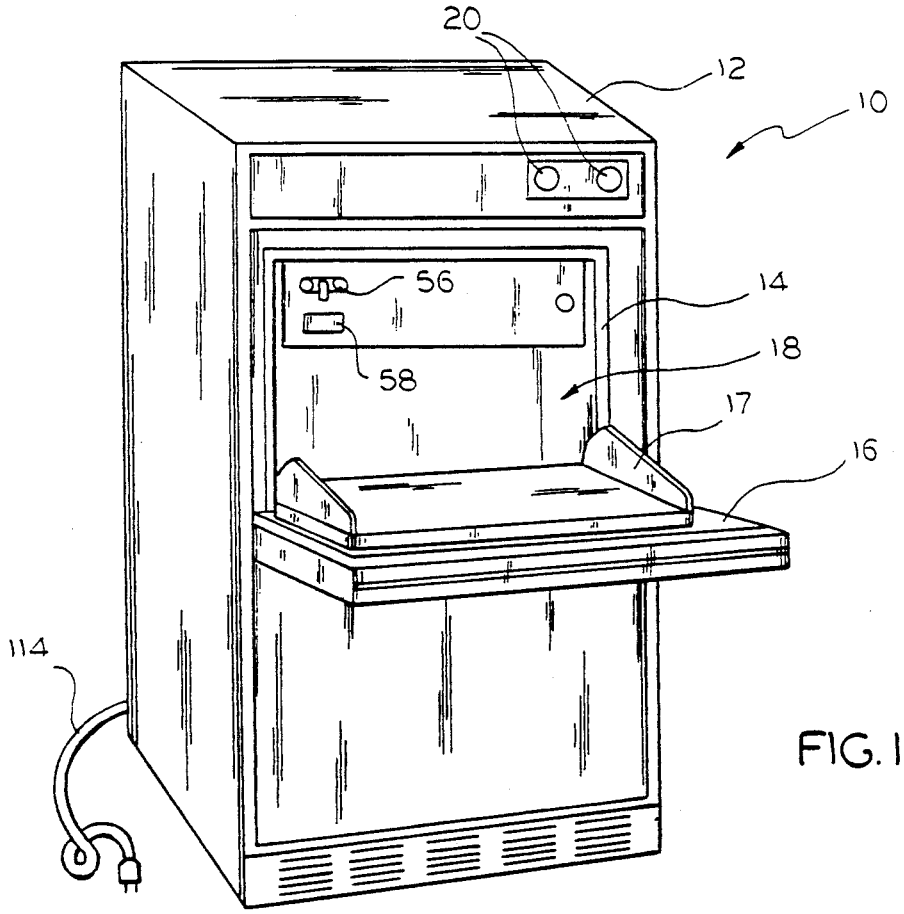
FIG. 1 is a perspective view of a combined ice cube making and pure water dispensing apparatus according to the invention.

In the illustrated embodiment of the invention a slab-type ice maker and water dispenser apparatus generally designated 10 comprises a cabinet 12 having a front opening 14 selectively closed by an outer door 16 and an inner door 17 for providing controlled access to an ice cube collecting bin 18. The cabinet 12 may be further provided with conventional control knobs 20 for manually adjusting the operation of the apparatus 10.

Figure 2:
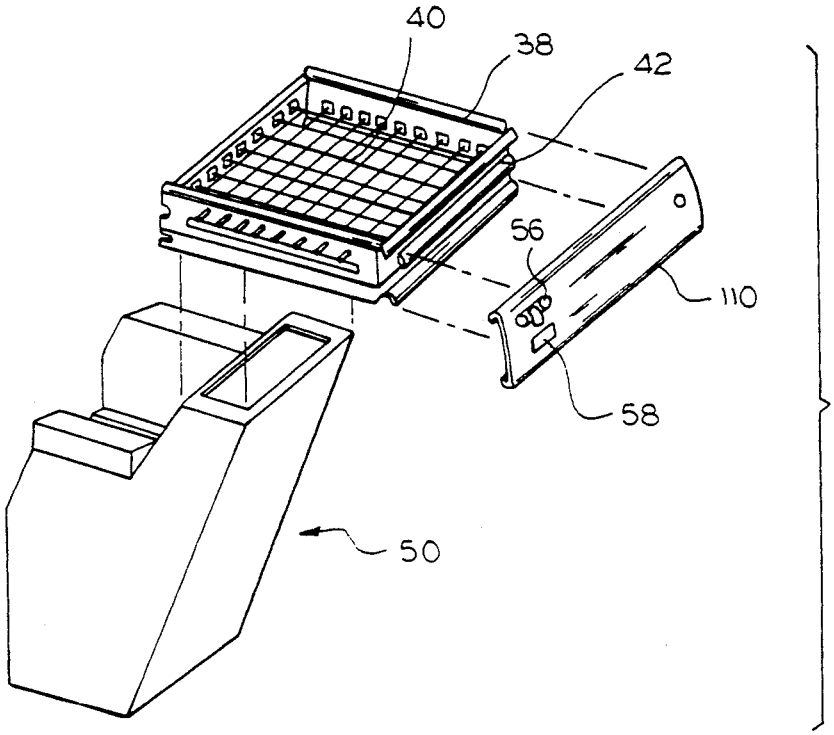
FIG. 2 is an exploded perspective view of the relative positioning between a water storage tank and slab-cutting grid of the apparatus of FIG. 1.
Figure 3:
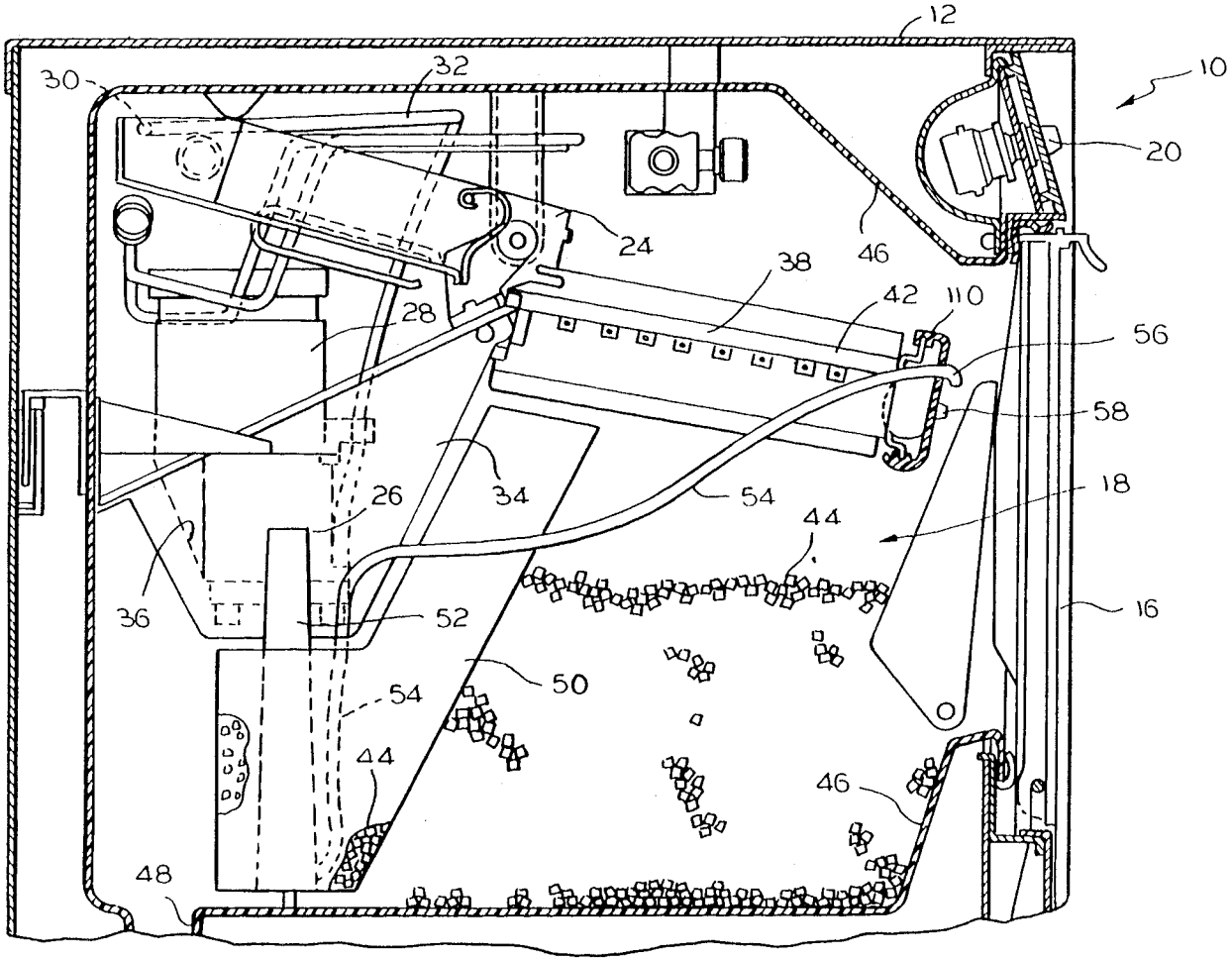
FIG. 3 is a partial sectional side elevational view of the apparatus of FIG. 1.
Figure 4:
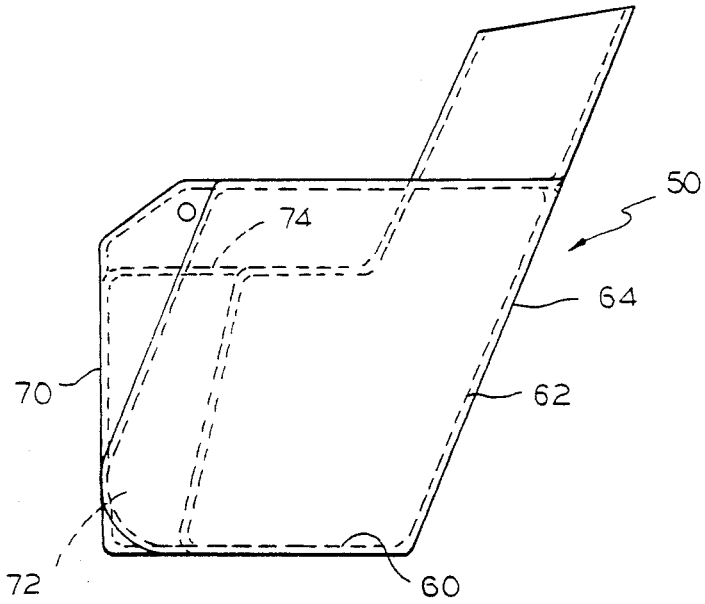
FIG. 4 is an elevational view of the water storage tank of FIG. 2.
Figure 6:
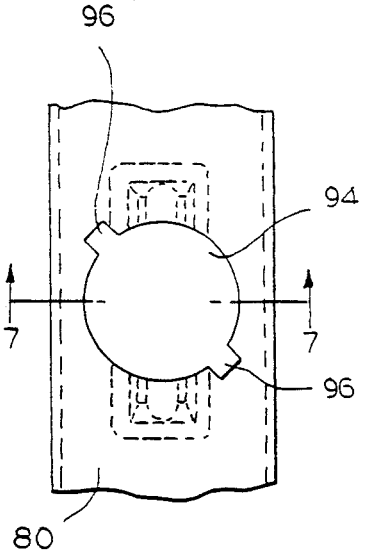
FIG. 6 is a detailed view of a pump mounting structure in the water storage tank of FIG. 2.
Figure 5:
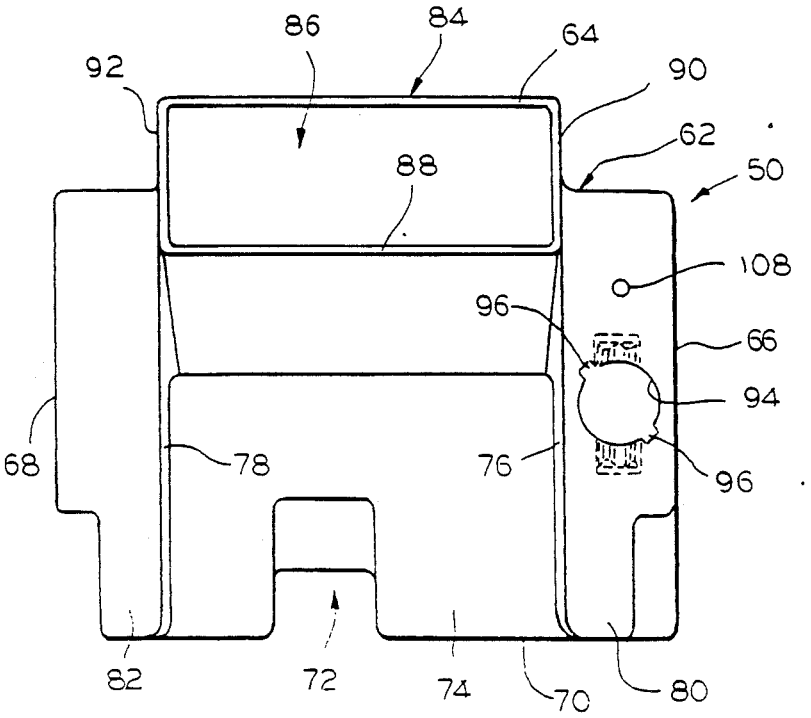
FIG. 5 is a plan view of the water storage tank of FIG. 2.
Figure 7:
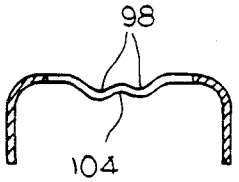
FIG. 7 is a sectional view taken along the line 7—7 of FIG. 6.

Referring now to FIGS. 2 and 3, the apparatus 10 comprises a slab-type ice maker having a refrigerated plate evaporator 24 which is adapted to be refrigerated by a conventional means as is well known to those skilled in the art. Water is circulated over the evaporator 24 by a pump 26 driven by a suitable electrical motor 28 connected to a distributor 30 by means of a conduit 32. After flowing over the evaporator 24 the water is returned to a subjacent water pan 34 having a sump portion 36 receiving the pump 26 for recirculation of the water to the distributor 30.

During normal operation of the apparatus 10, the flow of water over the refrigerated evaporator 24 slowly builds up a slab of ice on the upper surface of the evaporator 24. When the slab reaches a predetermined thickness, as may be determined by conventional controls means well known to those skilled in the art, the flow of water is terminated and the evaporator 24 is heated so as to release the slab from the evaporator 24. The plate is inclined downwardly toward a cutting grid 38 so that upon release of the slab from the evaporator 24, the slab falls onto a plurality of heated electric wires 40 forming a grid within a box frame 42. The heated wires 40 cut through the ice slab so as to cause the slab to be formed into a plurality of cube 44 which fall through the cutting grid 38 into the subjacent ice cube collecting bin 18.

The interior of the cabinet 12 is provided with a plastic liner 46 formed to generally conform to the shape of the cabinet and to define the collecting bin 18, as is specifically illustrated in FIG. 3. Although not shown, a suitable insulation layer is provided between the cabinet 12 and the liner 46. The liner 46 is provided with means for mounting the evaporator 24, the cutting grid 38 and the water pan 34 in the cabinet 12, as is more particularly illustrated in Barnard et al U.S. Pat. No. 4,009,595, assigned to the assignee of the present invention, and the specification of which is hereby incorporated by reference herein.

In operation, the apparatus 10 provides an endless supply of ice and is capable of forming, for example, 50 pounds of ice per day. However, suitable means are provided for preventing overflow in the collecting bin 18. As is conventional with such ice makers, the cabinet 12 is not itself refrigerated. Indeed, the only cooling provided within the cabinet is the radiant cooling provided by the evaporator 24, as well as the cooling provided by the ice cubes 44 within the collecting bin 18. Owing to the lack of refrigeration, the ice cubes 44 eventually melt and the resulting water is disposed through a drain 48 formed in the liner 46.

It has been found that the water produced by the melted ice cubes is generally pure, i.e. has impurity contents substantially lower than that of tap water. More specifically, the impurity content of such water compares favorably to bottled drinking water. This is due to the fact that during the process of forming a slab on the evaporator 24, the impurities do not freeze, but rather run off into the water pan 34 from which the impurity laden water is periodically flushed from the system and disposed of by any known means through the drain 48.

In accordance with the invention, the apparatus 10 includes pure water dispensing apparatus in the form of a water tank 50, a pump 52, a conduit 54, a spigot 56 and a dispenser lever 58.

The water storage tank 50, which is particularly illustrated with reference to FIG. 4–7, includes a bottom wall 60 connecting a peripheral side wall 62. The peripheral side wall 62 includes a vertically upwardly, forwardly angled front wall 64, opposite parallel outer side walls 66 and 68, and a rear wall 70 including an indent portion 72. An intermediate top wall 74 is connected between the rear wall 70 and spaced inner side walls 76 and 78 which are in turn connected to the respective outer side walls 66 and 68 by ledges 80 and 82. An upwardly extending neck 84 including an open top portion 86 is formed by the top of the front wall 64, an intermediate rear wall 88, connected to the intermediate top wall 74, and opposite neck side walls 90 and 92 which extend from the respective ledges 80 and 82. The configuration of the tank 50 is selected to fit within the collecting bin 18. Particularly, the intermediate top wall 74 is spaced from the bottom wall 60 so that it fits beneath the water pan 34. The rear wall indent 72 is provided for extending around water supply and drain lines not shown.

The tank 50 is positioned in relation to the liner 46 within the collecting bin 18 so that the open top portion 86 is disposed beneath the rearmost portion of the cutting grid 38, as illustrated in FIGS. 2 and 3. As such, ice cubes 44 cut by the heated wires 40 will fall either into the collecting bin 18 or into the storage tank 50 through the open top portion 86. The cubes 44 which fall into the storage tank 50 will melt to provide pure water, as discussed above However, the tank side wall 62 prevents intermixing between the cubes within the tank 50 and those within the collecting bin 18, outside of the tank 50. As a result, the cubes 44 within the storage tank 50 are not contaminated by hands or other instruments used to remove ice cubes 44 from the collecting bin 18. However, overflow of water or ice from the tank 50 will spill into the collecting bin 18.

In order to dispense pure water from the tank 50, the tank first ledge 80 is provided with a generally circular opening 94 including opposite notches 96. The ledge 80 is formed with suitable ridges 98 to strengthen the same and to hold the pump 52.

Figure 8:
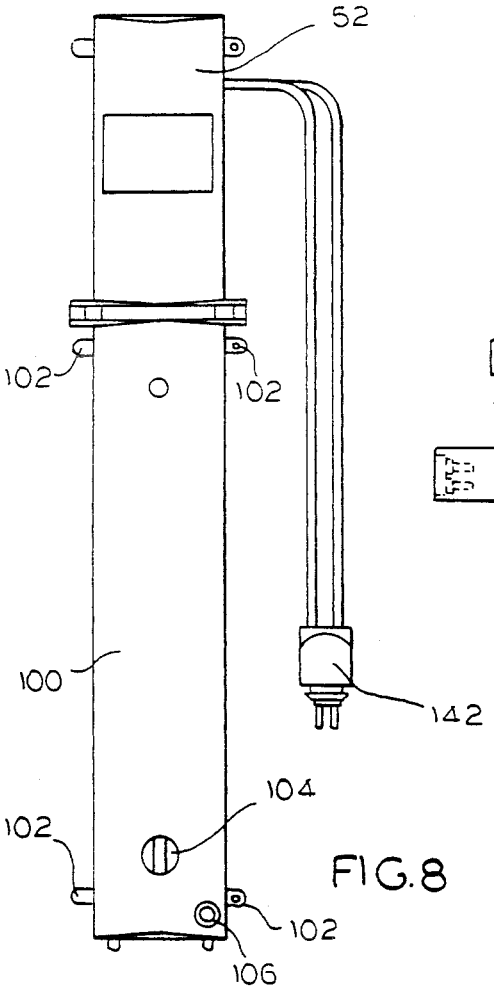
FIG. 8 is a side view of a pump for mounting in the storage tank of FIG. 2.
Figure 10:
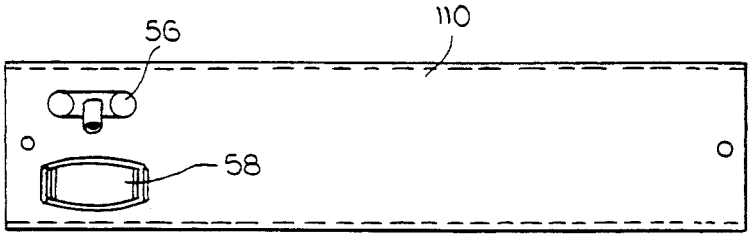
FIG. 10 is a front elevational view of a grid panel including the water dispensing apparatus.
Figure 11:
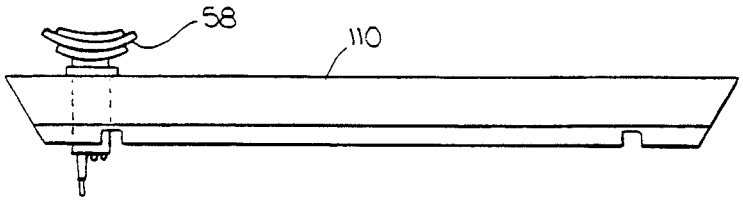
FIG. 11 is a bottom plan view of the grid panel of FIG. 10.

With reference to FIG. 8, the pump 52 comprises a submersible pump having a lower portion 100 which is inserted into the tank 50 through the opening 94. Top and bottom ears 102 are used for aligning the pump within the notches 96. Upon subsequent rotation of the pump 52 the ears 102 lock the pump 52 in place between the notches 98. Specifically, the upper ears 102 engage the underside of an indent 104 between the notches 98, see FIG. 7. The pump lower portion 100 includes opposite inlet openings 104 for receiving pure water, and an outlet 106 which connects to the conduit 54. Specifically, the conduit 54 is inserted through an opening 108 in the first ledge 80 to then extend downwardly into the tank 50. The pure water is pumped through the conduit 54 where it exits through the spigot 56 connected thereto With reference to FIGS. 9–11, the spigot 56 is mounted to a grid panel 110 which is mounted to the front of the cutting grid box frame 42, as shown in FIGS. 2–3. The grid panel 110 also supports the lever assembly 58 which is actuated by a suitable container (not shown) for receiving pure water. The dispenser 58 actuates an electrical switch 112 mounted at the rear side of the grid panel 110, which is operable to energize the pump 52.

Figure 12:
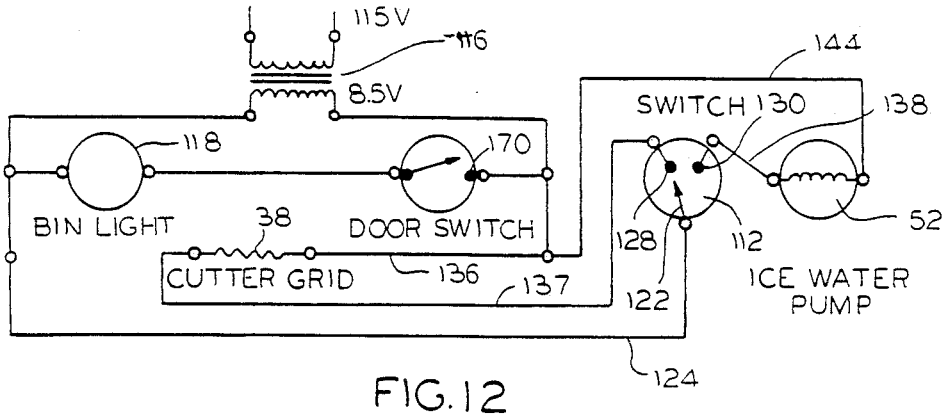
FIG. 12 is an electrical schematic illustrating connections for the water dispensing apparatus.

With reference also to FIG. 12, an electrical schematic illustrates electrical connections used for operation of the water dispensing apparatus.

The apparatus 10 receives power via a cord and socket 114, see FIG. 1. A step down transformer 116 transforms 115 volt AC Power to low voltage AC Power. For example, in the illustrated embodiment, the voltage is reduced to approximately 8.5 volts. A bin light 118 is connected in series with a door switch 120 across the secondary of the transformer 116. The door switch is actuated upon opening the door 16 to energize the bin light 118 and illuminate the collecting bin 18.

Figure 9:
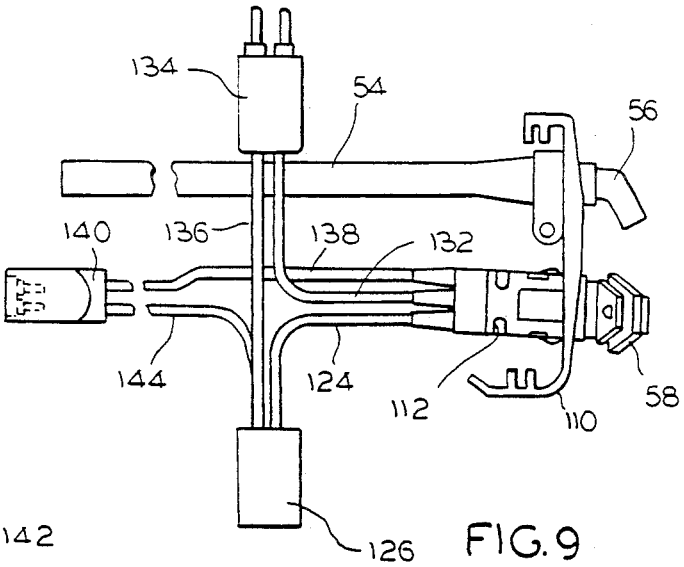
FIG. 9 is a side view illustrating water and electrical connections to a water dispenser of the apparatus of FIG. 1.

The switch 112 includes a movable contact 122 connected via a conductor 124, through a socket 126, see FIG. 9, to one side of the secondary of the transformer 116. The switch 112 also includes a first fixed contact 128 and a second fixed contact 130. The first fixed contact 128 is connected via a conductor 132, through a plug 134, see FIG. 9, to the cutter grid 38. The other side of the cutter grid 38 is connected through a conductor 136, between plugs 126 and 134, see FIG. 9, to the other side of the secondary of the transformer 116. The switch second fixed contact 130 is connected via a conductor 138, through a socket 140 and pump plug 142, see FIG. 9, to the pump 52. The opposite side of the pump 52 is connected through the plug 142 and socket 140 to a conductor 144 which is connected through the socket 126 to the secondary of the transformer 116.

In operation, the switch 112 is normally positioned so that the movable contact 122 makes electrical contact with the first fixed contact 128. Thus, the cutter grid 38 is normally connected across the secondary of the transformer 116 and is thus energized. If it is desired to dispense pure water through the spigot 56, a container is used to operate the dispenser lever 58 which causes the movable contact 122 to break contact with the first fixed contact 128 and make contact with the second fixed contact 130. As a result, the pump 52 is connected across the secondary of the transformer 116 and is thus energized. Energization of the pump 52 causes pure water to be pumped through the water conduit 54 and out the spigot 56 to the subjacent container which is actuating the dispenser lever 58.

In accordance with the invention, the pure water dispenser apparatus is adapted so that in addition to being factory installed, it may be sold as a field installation kit for installation in existing ice making apparatus of the form generally described in the Barnard et al patent incorporated by reference herein.

Specifically, with such a kit the water storage tank 50, including the pump 52 inserted therein, can be positioned within the collecting bin 18. A grid panel, similar to the grid panel 110 except without the spigot 56 and lever 58, on the existing ice maker is then removed and replaced with the grid panel 110 illustrated in FIG. 9 including the wire harness and suitable plugs and sockets, to replace an existing wire harness in the icemaker which connects the cutter grid 38 to the transformer 116. Thus, the existing ice maker is converted to a combined ice maker and pure water dispenser.

In order to provide for periodic service of the water dispensing apparatus, the tank 50 and pump 52 are removable. Specifically, and with reference to FIGS. 13–16, a procedure for removing same as illustrated.

Figure 13:
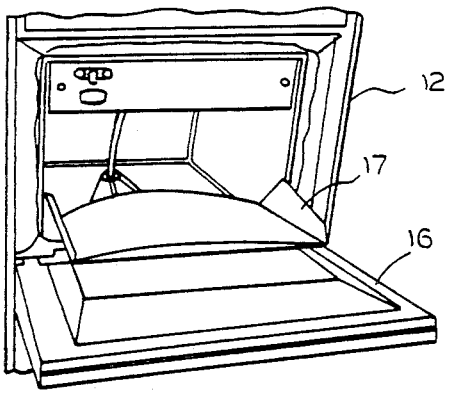
FIGS. 13–16 illustrate removal of the water storage tank from the apparatus of FIG. 1.
Figure 14:
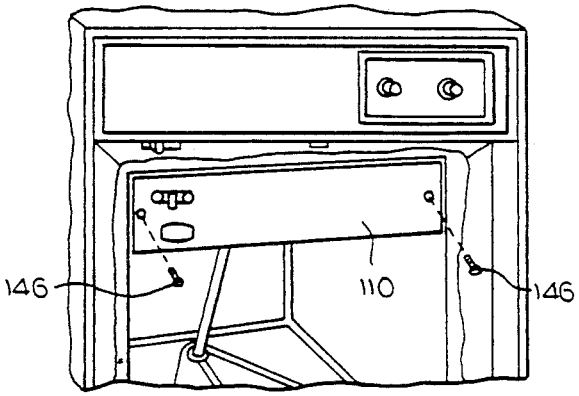
Figure 15:
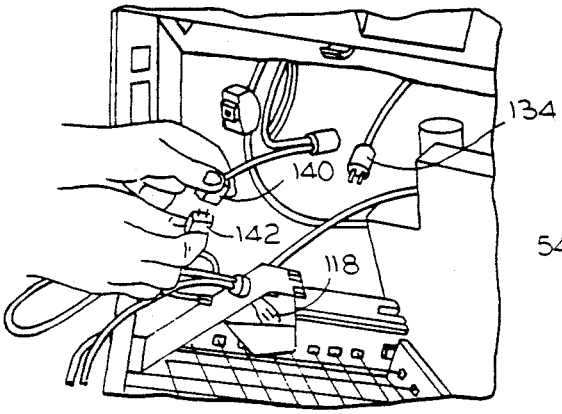
Figure 16:
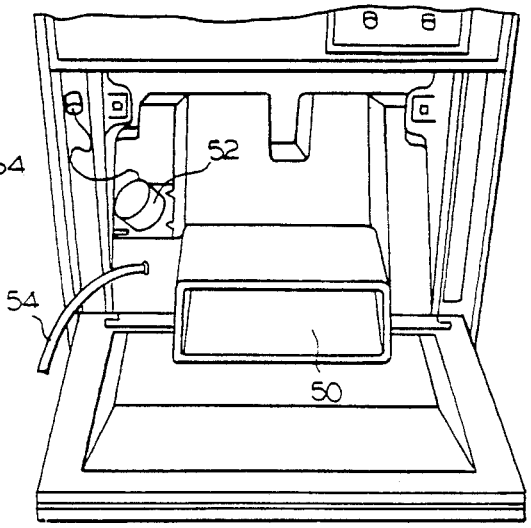

To remove the tank 50, the inner door 17 is flexed and removed as particularly illustrated in FIG. 13. Next, two thumb screws 146 holding the grid panel 110 to the cutter grid box frame 42 are removed, as illustrated in FIG. 14. Thereafter, the plug 134 to the cutting grid 38 is disconnected, as is the socket 140 and the plug 142 to disconnect the cutting grid 38 and pump 52, as illustrated in FIG. 15. Finally, the water tank 50 is titled forwardly and pulled outwardly as illustrated in FIG. 16. In order to completely remove the tank 50, the conduit 54 must be removed from the pump outlet 106. Thereafter, the tank 50 and pump 52 may be serviced as necessary then reinstalled following the reverse procedure.

The procedure for installing a pure water dispensing kit is similar to the procedure for reinstalling the tank 50 and the pump 52 after servicing, with the added step of replacing the grid panel 110 including the cable harness and water conduit 54 connected thereto, as a substitute for the grid panel in the existing ice maker apparatus.

Figure 17:
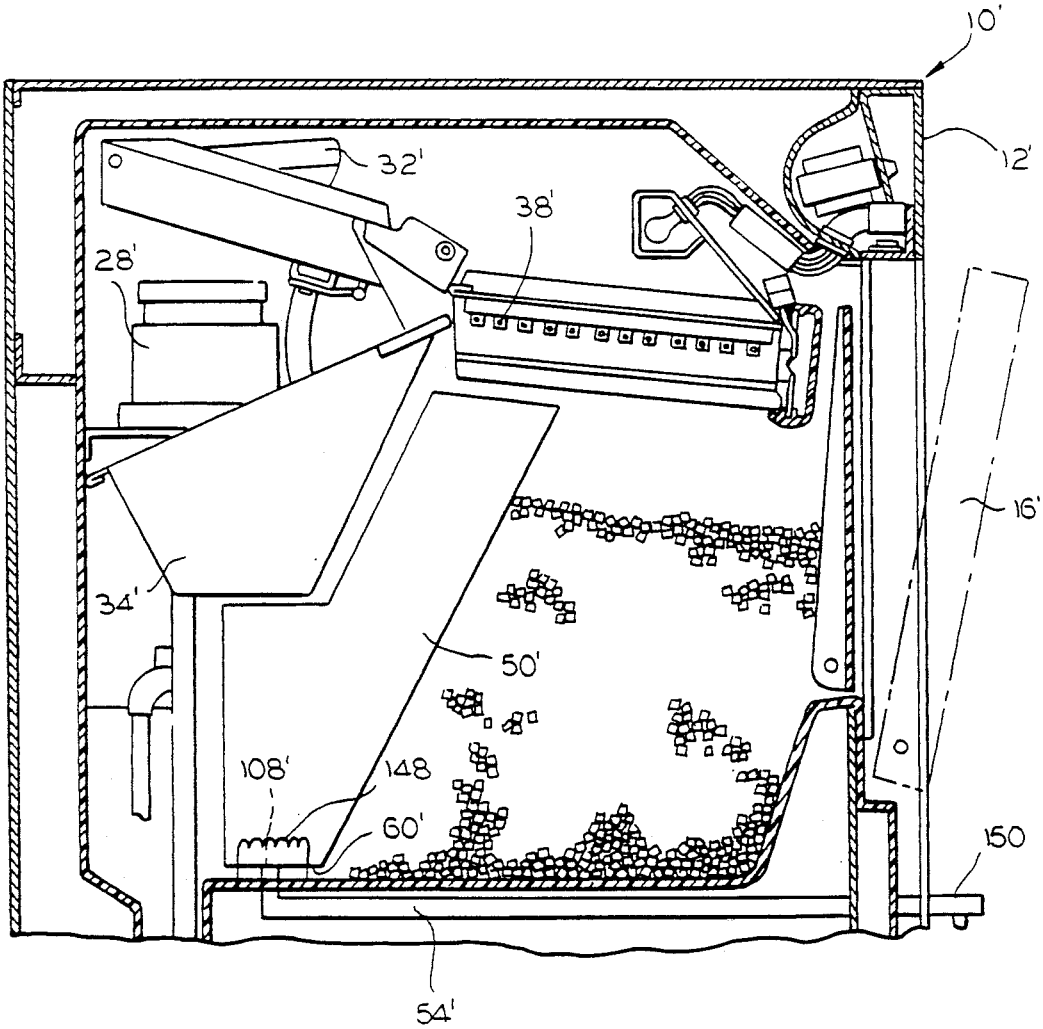
FIG. 17 is a view similar of that to FIG. 3 according to an alternative embodiment to the invention.

With reference to FIG. 17, an apparatus 10' according to an alternative embodiment to the invention is illustrated. The apparatus 10' is generally similar to the apparatus 10 shown in FIGS. 1–16, except that the pump 52 is eliminated and an optional heater 148 is included for facilitating melting of ice in the storage tank 50'.

For simplicity, primed reference numerals are used to refer to elements similar to elements referenced to unprimed numerals in FIG. 3.

The storage tank 50' differs from the storage tank 50 in eliminating the requirement for the ledge openings 94 and 108 due to the elimination of the pump 52. Instead, a suitable opening 108' is provided in the bottom wall 60' for connection to a conduit 54' which extends to a combined valve and dispenser 150 on the cabinet 12' below the door 16'. As a result, pure water is gravity fed from the storage tank 50' through the conduit 54' and out the dispenser 150 upon actuation of the same, as is apparent. The heater 148 is mounted in the bottom of the storage tank 50' and, although not shown, is preferably connected in parallel with the cutter grid 38'. Thus, the heater 148 facilitates the melting of ice to provide pure water.

Thus, in accordance with the invention, a combined ice maker and water dispensing apparatus 10 is operable to form clear ice cubes and to melt a select portion of the same to provide substantially pure water. By suitably selecting the size and/or position of the open top portion 86 of the water storage tank 50, the relative ratio of ice cubes 44 which fall into the storage tank 50 and into the collecting bin 18 can be selected. The particular ratio would be selected in order to satisfy normal requirements of both ice and water.

Further, in accordance with the invention; the storage tank 50 is positioned with its open top portion 86 in close proximity to the cutting grid 38 to prevent ice cubes 44 that fall into the collecting bin 18, outside of the storage tank 50, from subsequently entering into the storage tank 50. Further, there is no intermixing of melted water from the collecting bin 18 with that in the storage tank 50. As a result, the water in the storage tank 50 will not be contaminated.

The illustrated embodiments of the invention comprehend the broad inventive concepts contemplated by the invention.

We claim:

1. In an ice making apparatus having a cabinet provided with means for forming a plurality of ice bodies in a batch and an ice collecting bin therebelow for storing formed ice bodies, the improvement comprising:

a water storage tank positioned in said ice collecting bin and having an open top portion for receiving a select portion of the plurality of ice bodies formed by said forming means in each batch, the remaining ice bodies formed in the batch being received in the collecting bin and to melt the same to provide fresh water, said top portion being positioned to prevent entry of ice bodies from the collecting bin; and means for delivering a desired quantity of fresh water from said tank to a water dispenser associated with said cabinet.

2. The improvement of claim 1 wherein said tank open top portion is of a size selected to determine the relative quantity of ice bodies received in said storage tank.

3. The improvement of claim 1 wherein said delivering means comprises a pump.

4. In an ice making apparatus having a cabinet provided with means for forming a plurality of ice bodies and an ice collecting bin therebelow for storing formed ice bodies, the improvement comprising:

a water storage tank positioned in said ice collecting bin, said tank being removable from said collecting bin and having an open top portion for receiving a select portion of the plurality of ice bodies formed by said forming means and to melt the same to provide fresh water, said top portion being positioned to prevent entry of ice bodies from the collecting bin; and means for delivering a desired quantity of fresh water from said tank to a water dispenser associated with said cabinet.

5. In an ice making apparatus having a cabinet provided with means for forming a plurality of ice bodies and an ice collecting bin therebelow for storing formed ice bodies, the improvement comprising:

a water storage tank is positioned in said ice collecting bin and having an open top portion for receiving a select portion of the plurality of ice bodies formed by said forming means and to melt the same to provide fresh water, said top portion being positioned to prevent entry of ice bodies from the collecting bin;

means for delivering a desired quantity of fresh water from said tank to a water dispenser associated with said cabinet; and means for heating said water storage tank to facilitate melting of ice bodies received therein.

6. In a slab type ice maker having a cabinet provided with an inner liner defining an ice collecting bin, a slab-forming evaporator forming an ice slab, and a slab-cutting grid for cutting said slab to provide a plurality of ice bodies which fall into the ice collecting bin, a pure water dispensing apparatus comprising:

a water storage tank having an open top portion of a select size;

means for positioning said tank in said collecting bin with said open top portion disposed subjacent a select portion of said slab-cutting grid so that said storage tank receives a select partial portion of the plurality of ice bodies cut by said slab-cutting grid according to the select size of the open top portion and to melt the same to provide fresh water; and means for delivering a desired quantity of fresh water from said tank to a water dispenser associated with said cabinet.

7. The pure water dispensing apparatus of claim 6 wherein said tank open top portion is positioned beneath a rear portion of said slab-cutting grid.

8. The pure water dispensing apparatus of claim 6 wherein said delivering means comprises a pump.

9. The pure water dispensing apparatus of claim 6 further comprising means associated with said storage tank for preventing entry of ice from said collecting bin.

10. The pure water dispensing apparatus of claim 6 wherein said storage tank is positioned to permit overflow of pure water into said collecting bin.

11. In a slab type ice maker having a cabinet provided with an inner liner defining an ice collecting bin, a slab-forming evaporator forming an ice slab, and a slab-cutting grid for cutting said slab to provide a plurality of ice bodies which fall into the ice collecting bin, a pure water dispensing apparatus comprising:

a water storage tank having an open top portion, said tank being removable from said collecting bin;

means for positioning said tank in said collecting bin with said open top portion disposed subjacent a select portion of said slab-cutting grid so that said storage tank receives a select portion of the plurality of ice bodies cut by said slab-cutting grid and to melt the same to provide fresh water; and means for delivering a desired quantity of fresh water from said tank to a water dispenser associated with said cabinet.

12. In a slab type ice maker having a cabinet provided with an inner liner defining an ice collecting bin, a slab-forming evaporator forming an ice slab, and a slab-cutting grid for cutting said slab to provide a plurality of ice bodies which fall into the ice collecting bin, a pure water dispensing apparatus comprising:

a water storage tank having an open top portion;

means for positioning said tank in said collecting bin with said open top portion disposed subjacent a select portion of said slab-cutting grid so that said storage tank receives a select portion of the plurality of ice bodies cut by said slab-cutting grid and to melt the same to provide fresh water;

means for delivering a desired quantity of fresh water from said tank to a water dispenser associated with said cabinet; and means for heating said water storage tank to facilitate melting of ice bodies received therein.

13. In a slab type ice maker having a cabinet provided with an inner liner defining an ice collecting bin, a slab-forming evaporator forming an ice slab, and a slab-cutting grid for cutting said slab to provide a plurality of ice bodies which fall into the ice collecting bin, a pure water dispensing apparatus comprising:

a water storage tank having an open top portion;

means for positioning said tank in said collecting bin with said open top portion disposed subjacent a select portion of said slab-cutting grid so that said storage tank receives a select portion of the plurality of ice bodies cut by said slab-cutting grid and to melt the same to provide fresh water; and means for delivering a desired quantity of fresh water from said tank to a water dispenser associated with said cabinet said dispensing means comprising a conduit extending between said tank and a spigot mounted in said cabinet.

14. A combined ice cube making and pure water dispensing apparatus comprising:

a cabinet provided with an inner liner defining an ice collecting bin, an access opening for providing access to said collecting bin and a door for closing said opening;

an ice maker mounted in said cabinet including a slab-forming evaporator forming an ice slab, and a slab-cutting grid for cutting said slab to provide a plurality of ice cubes which fall into the ice collecting bin;

a water storage tank having an open top portion;

means for mounting said tank in said collecting bin with said open top portion disposed subjacent a select portion of said slab-cutting grid so that said storage tank receives a select partial portion of the plurality of ice cubes from each slab cut by said slab-cutting grid and to melt the same to provide fresh water, the remaining ice cubes falling into the collecting bin; and means for delivering a desired quantity of fresh water from said tank to a water dispenser associated with said cabinet.

15. The apparatus of claim 14 wherein said tank open top portion is of a size selected to determine the relative quantity of ice bodies received in said storage tank.

16. The apparatus of claim 14 wherein said delivering means comprises a pump.

17. The apparatus of claim 14 further comprising means associated with said storage tank for preventing entry of ice cubes from said collecting bin.

18. The apparatus of claim 14 wherein said storage tank is positioned to permit overflow of pure water into said collecting bin.

19. A combined ice cube making and pure water dispensing apparatus comprising:

a cabinet provided with an inner liner defining an ice collecting bin, an access opening for providing access to said collecting bin and a door for closing said opening;

an ice maker mounted in said cabinet including a slab-forming evaporator forming an ice slab, and a slab-cutting grid for cutting said slab to provide a plurality of ice cubes which fall into the ice collecting bin;

a water storage tank having an open top portion, said tank being removable from said collecting bin;

means for mounting said tank in said collecting bin with said open top portion disposed subjacent a select portion of said slab-cutting grid so that said storage tank receives a select portion of the plurality of ice cubes cut by said slab-cutting grid and to melt the same to provide fresh water; and means for delivering a desired quantity of fresh water from said tank to a water dispenser associated with said cabinet.

20. A combined ice cube making and pure water dispensing apparatus comprising:

a cabinet provided with an inner liner defining an ice collecting bin, an access opening for providing access to said collecting bin and a door for closing said opening;

an ice maker mounted in said cabinet including a slab-forming evaporator forming an ice slab, and a slab-cutting grid for cutting said slab to provide a plurality of ice cubes which fall into the ice collecting bin;

a water storage tank having an open top portion;

means for mounting said tank in said collecting bin with said open top portion disposed subjacent a select portion of said slab-cutting grid so that said storage tank receives a select portion of the plurality of ice cubes cut by said slab-cutting grid and to melt the same to provide fresh water;

means for delivering a desired quantity of fresh water from said tank to a water dispenser associated with said cabinet; and means for heating said water storage tank to facilitate melting of ice bodies received therein.

21. A combined ice cube making and pure water dispensing apparatus comprising:

a cabinet provided with an inner liner defining an ice collecting bin, an access opening for providing access to said collecting bin and a door for closing said opening;

an ice maker mounted in said cabinet including a slab-forming evaporator forming an ice slab, and a slab-cutting grid for cutting said slab to provide a plurality of ice cubes which fall into the ice collecting bin;

a water storage tank having an open top portion;

means for mounting said tank in said collecting bin with said open top portion disposed subjacent a select portion of said slab-cutting grid so that said storage tank receives a select portion of the plurality of ice cubes cut by said slab-cutting grid and to melt the same to provide fresh water; and means for dispensing a desired quantity of fresh water from said tank to a water dispenser associated with said cabinet, said dispensing means comprising a conduit extending between said tank and a spigot mounted in said cabinet.

22. A combined ice cube making and pure water dispensing apparatus comprising:

a cabinet provided with an inner liner defining an ice collecting bin, an access opening for providing access to said collecting bin and a door for closing said opening;

an ice maker mounted in said cabinet including a slab-forming evaporator forming an ice slab, and a slab-cutting grid for cutting said slab to provide a plurality of ice cubes which fall into the ice collecting bin;

a water storage tank having an open top portion;

means for mounting said tank in said collecting bin with said open top portion disposed subjacent a select portion of said slab-cutting grid so that said storage tank receives a select portion of the plurality of ice cubes cut by said slab-cutting grid and to melt the same to provide fresh water; and means for delivering a desired quantity of fresh water from said tank to a water dispenser associated with said cabinet, wherein said water dispenser is mounted in said cabinet behind said door.

23. For or use with a slab type ice maker having a cabinet provided with an inner liner defining an ice collecting bin, a slab-forming evaporator forming an ice slab, and a slab-cutting grid for cutting said slab to provide a plurality of ice bodies which fall into the ice collecting bin, a pure water dispensing apparatus insert kit comprising:

a water storage tank having a bottom wall connected to a peripheral sidewall to provide an open top portion, said tank being positionable in said collecting bin with said open top portion disposed subjacent a select portion of said slab-cutting grid so that said storage tank receives a select portion of the plurality of ice bodies cut by said slab-cutting grid to melt the same to provide fresh water;

a pump removably mounted in said storage tank; and means for delivering a desired quantity of fresh water from said tank via said pump to a water dispenser mountable to said cabinet.

24. The insert kit of claim 23 wherein said tank open top portion is of a size selected to determine the relative quantity of ice bodies received in said storage tank.

25. The insert kit of claim 23 wherein said dispensing means comprises a conduit extending between said pump and a spigot mountable in said cabinet.

* * * * *